US008820115B2

(12) United States Patent
Howard et al.

(10) Patent No.: US 8,820,115 B2
(45) Date of Patent: Sep. 2, 2014

(54) OXYGEN PRODUCTION METHOD AND APPARATUS

(75) Inventors: Henry Edward Howard, Grand Island, NY (US); Richard John Jibb, Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 1106 days.

(21) Appl. No.: 12/634,810

(22) Filed: Dec. 10, 2009

(65) Prior Publication Data

US 2011/0138855 A1 Jun. 16, 2011

(51) Int. Cl.
*F25J 3/00* (2006.01)
*F25J 3/04* (2006.01)

(52) U.S. Cl.
CPC ..... *F25J 3/04084* (2013.01); *F25J 3/04957* (2013.01); *F25J 3/04951* (2013.01); *F25J 3/0409* (2013.01); *F25J 3/04296* (2013.01); *F25J 3/04412* (2013.01); *F25J 3/04872* (2013.01); *F25J 3/04963* (2013.01); *F25J 2200/32* (2013.01); *F25J 2205/30* (2013.01); *F25J 2245/42* (2013.01); *F25J 3/0423* (2013.01)
USPC ..... 62/646; 62/643; 62/644; 62/647

(58) Field of Classification Search
CPC . F25J 3/04951; F25J 3/04957; F25J 3/04963; F25J 3/04666; F25J 3/0443
USPC ..... 62/644, 643, 646, 647
See application file for complete search history.

(56) References Cited

U.S. PATENT DOCUMENTS

| | | | | |
|---|---|---|---|---|
| 4,254,629 | A | 3/1981 | Olszewski | |
| 4,453,957 | A | 6/1984 | Pahade et al. | |
| 5,682,764 | A * | 11/1997 | Agrawal et al. | 62/646 |
| 5,966,967 | A * | 10/1999 | Agrawal et al. | 62/650 |
| 6,128,921 | A | 10/2000 | Guillard et al. | |
| 6,227,005 | B1 * | 5/2001 | Higginbotham et al. | 62/646 |
| 6,651,460 | B2 | 11/2003 | O'Connor | |
| 6,666,048 | B1 | 12/2003 | Brugerolle et al. | |
| 2004/0261453 | A1 * | 12/2004 | Guillard et al. | 62/643 |
| 2008/0223077 | A1 * | 9/2008 | Prosser et al. | 62/646 |

* cited by examiner

*Primary Examiner* — Frantz Jules
*Assistant Examiner* — Keith Raymond
(74) *Attorney, Agent, or Firm* — David M. Rosenblum

(57) ABSTRACT

A method and apparatus for producing an oxygen product in which air is separated in an installation including air separation units having higher and lower pressure columns. A pumped liquid stream generated within the installation, that can be a pumped liquid oxygen stream, is warmed within a main heat exchanger through indirect heat exchange with a compressed air stream to produce a liquid air stream. An impure oxygen stream is rectified within an auxiliary column to produce an oxygen containing stream that is introduced into the lower pressure column of each of the air separation units and intermediate liquid streams, composed of the liquid air stream or another air-like stream, reflux the lower pressure columns and the auxiliary column and optionally the higher pressure column of each of the air separation units.

17 Claims, 1 Drawing Sheet

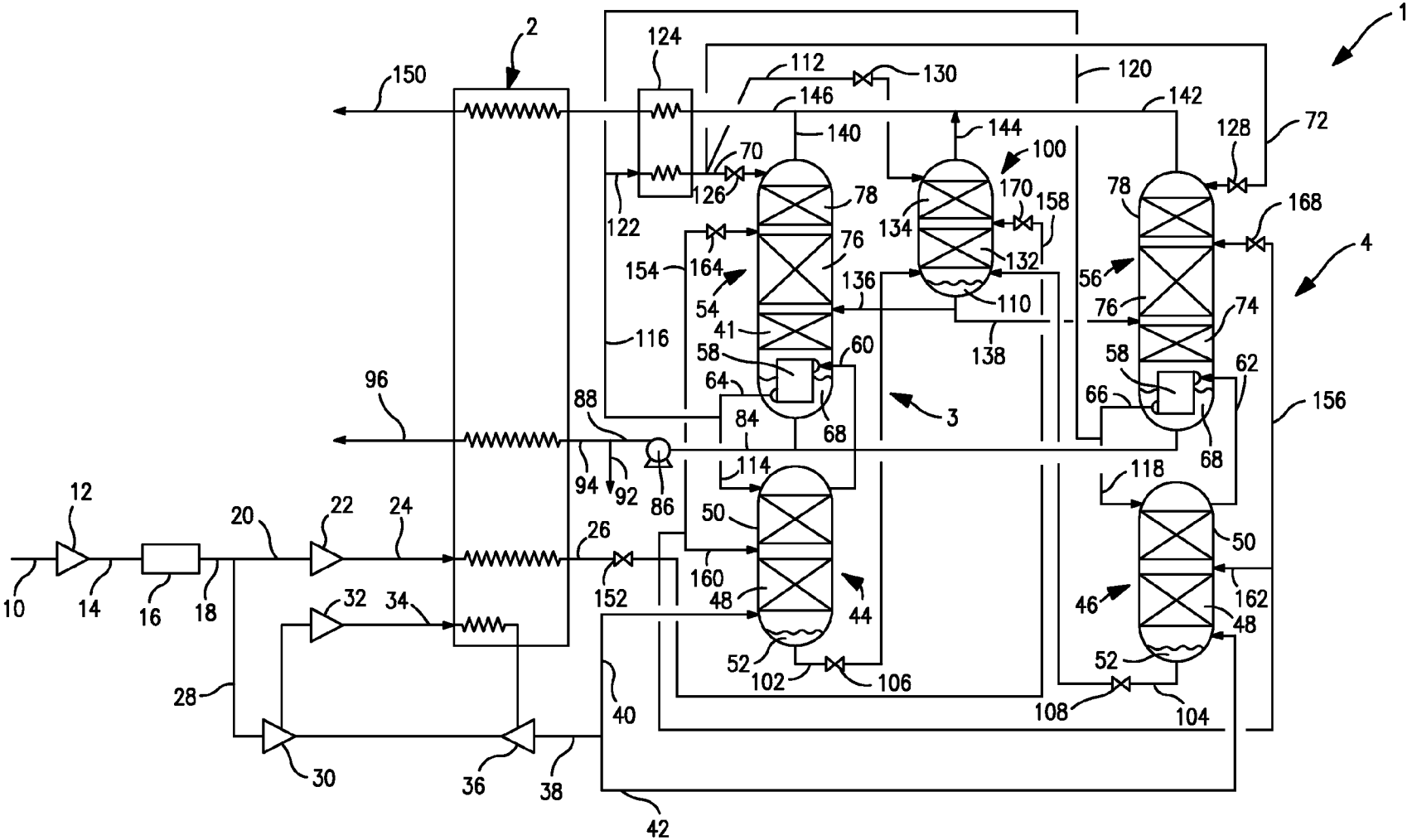
1
4
3
2
156
168
72
128
142
120
74
62
68
78
76
58
66
56
50
162
48
104
118
52
46
108
100
158
170
132
110
138
144
134
130
136
60
140
146
112
70
126
164
54
41
84
114
106
44
102
160
124
122
154
116
86
92
88
94
26
152
40
42
38
36
150
96
24
34
22
32
30
20
18
28
16
14
12
10

OXYGEN PRODUCTION METHOD AND APPARATUS

FIELD OF THE INVENTION

The present invention relates to a method of producing an oxygen product and an apparatus to conduct such method. More particularly, the present invention relates to such a method and apparatus in which multiple air separation units, each having a higher and a lower pressure columns, are connected to an auxiliary column that produces oxygen containing streams that are lean in nitrogen and that are introduced into the lower pressure columns to allow the air separation units to operate at a higher capacity.

BACKGROUND OF THE INVENTION

Large quantities of oxygen are required for purposes of coal gasification, production of synthetic liquid fuels and in combustion processes involving the use of oxygen. In certain of the foregoing processes, upwards of between 10,000 and 15,000 metric tons per day of oxygen can be consumed.

The cryogenic rectification of air is the preferred method for large scale oxygen production. In cryogenic rectification, air is compressed and purified of higher boiling contaminants such as carbon dioxide, water vapor and hydrocarbons in a pre-purification unit. The compressed and purified air, which in certain plants can be further compressed, is cooled to a temperature suitable for its rectification and then rectified in distillation columns to separate the components of the air. The distillation columns that are employed in cryogenic rectification processes include a higher pressure column and a lower pressure column. In the higher pressure column, the air is rectified to produce a nitrogen-rich vapor column overhead and a crude liquid oxygen column bottoms also known in the art as kettle liquid. A stream of the crude liquid oxygen column bottoms is further refined in the lower pressure column to produce the oxygen product.

Distillation column diameters increase in proportion to the square root of plant capacity or in other words the flow through the columns. Shipping limitations result in a maximum vessel diameter in the range of 6.0 to 6.5 m. As a consequence, the design, construction and installation of an air separation plant having an oxygen production capacity in excess of about 5000 metric tons per day has not been found to be practical. In order to overcome this limitation, typically multiple, parallel air separation plant trains are constructed to operate in parallel within an enclave. Unfortunately simple plant replication forfeits many "economies of scale" in that the construction of additional column shells carries with it considerable expense. Thus, even when multiple air separation units having higher and lower pressure columns are employed within an enclave of such units, it is desirable that each such unit be constructed with the largest capacity possible to limit the number of units employed within a particular installation of air separation plants.

A critical limitation associated with a distillation column involves the hydraulic flood point of any given column section. Column diameters are typically defined by an approach to flood that can be anywhere from 70 to 90 percent. Given equivalent pressure, nitrogen has a lower mass density than oxygen. As the lighter (more volatile) component of air, nitrogen flows to the top of the associated (nitrogen/oxygen) rectification sections. As the column vapor ascends it is progressively enriched in nitrogen. Conversely, the descending liquid becomes richer in oxygen. As a consequence of these thermodynamic aspects, the upper sections of the major low pressure air distillation columns, known as the nitrogen rectification sections, exhibit the highest volumetric loadings. Given a fixed maximum diameter and packing selection, such sections will limit capacity of each plant.

As will be discussed, the present invention provides a method and apparatus by which air separation units can be integrated in a manner that will increase plant capacity and the production of oxygen within plant enclaves having multiple plants.

SUMMARY OF THE INVENTION

In one aspect, the present invention provides a method of producing an oxygen product. In accordance with this aspect of the present invention, air is separated by a cryogenic rectification process employing a plurality of air separation units having higher pressure columns and lower pressure columns operatively associated with the higher pressure columns producing oxygen-rich streams that are utilized in producing the oxygen product. The cryogenic rectification process generates at least one liquid stream composed of air or an air-like substance having an argon content no less than air and at least one impure oxygen stream containing oxygen and nitrogen and having an oxygen content no less than that of the air.

The at least one impure oxygen stream is introduced into a bottom region of an auxiliary column operating at substantially the same pressure as the lower pressure column.

The at least one impure oxygen stream is rectified within the auxiliary column to form an oxygen containing liquid as a column bottoms and an auxiliary column nitrogen-rich vapor column overhead. Oxygen containing streams are withdrawn from the auxiliary column having a lower nitrogen content of that of the at least one impure oxygen stream and are introduced into the lower pressure columns for rectification within the lower pressure columns. Intermediate reflux streams composed of the at least one liquid stream are introduced into the lower pressure columns above locations at which the oxygen containing streams are introduced and into the auxiliary column above the bottom region thereof.

The present invention allows for an increase in oxygen production within a multiple plant installation in which a single auxiliary column is used to divert nitrogen from the lower pressure columns within the installation by the production of an oxygen-rich liquid that is fed into the lower pressure columns. The diversion of the nitrogen from the lower pressure column in turn reduces vapor loadings within the nitrogen rectification sections of such columns to increase plant capacity. It has been calculated that the use of such an auxiliary column could increase plant capacity between 25 and 30 percent of each of the plants located in the installation. As can be appreciated, in a multiple plant installation, this increase in capacity could save the use of a plant in the installation and would therefore reduce the costs involved in constructing the installation.

It is to be noted that the term "substantially" as used herein and in the claims means the same pressure or a pressure that is slightly higher than the pressure of the lower pressure column by no more than 5 psig to drive oxygen containing streams produced in the auxiliary column into the lower pressure columns. Further, the at least one impure oxygen stream can be impure oxygen streams withdrawn from all of the air separation units and introduced into the lower pressure column.

A pumped liquid oxygen plant is a particularly advantageous type of plant that can be used in connection with the present invention. As such, the oxygen-rich streams can be composed of an oxygen-rich liquid column bottoms produced in the lower pressure columns. At least part of each of the oxygen-rich liquid streams are pumped to form at least one pumped liquid oxygen stream. Part of the air to be separated is compressed to form at least one compressed air stream and the at least one compressed air stream indirectly exchanges heat with at least part of the at least one pumped liquid oxygen stream. This forms the at least one liquid stream from the compressed air stream and the oxygen product from the at least part of the at least one pumped liquid oxygen stream. The impure oxygen streams can be withdrawn from the higher pressure columns and can be composed of a crude liquid oxygen column bottoms produced within the higher pressure columns of the air separation units.

A higher pressure nitrogen-rich column overhead produced in the higher pressure columns is condensed into a nitrogen-rich liquid against vaporizing part of the oxygen-rich liquid column bottoms. Reflux liquid streams composed of the nitrogen-rich liquid are introduced as reflux into the higher pressure columns and the lower pressure columns and the auxiliary column. The nitrogen-rich liquid, that is used in forming the reflux liquid streams that are fed as the reflux to the lower pressure columns and the auxiliary column, is subcooled through indirect heat exchange with at least one lower pressure nitrogen vapor stream composed of a lower pressure nitrogen column overhead produced in the lower pressure columns of the air separation units. The nitrogen-rich auxiliary column overhead and the at least one lower pressure nitrogen vapor stream are fully warmed in at least one main heat exchanger used in cooling the air to a temperature suitable for its rectification within the air separation units.

The intermediate reflux streams can also be introduced into the higher pressure column of each of the air separation units. Another part of the air can be further compressed, partly cooled and expanded, thereby to form at least one exhaust stream. Primary feed air streams composed of the at least one exhaust stream are introduced into the higher pressure columns.

In another aspect, the present invention provides an apparatus for producing an oxygen product. In accordance with this aspect of the present invention, a cryogenic rectification installation is provided that is configured to separate the air and thereby produce the oxygen product. The cryogenic rectification installation includes at least one main heat exchanger and air separation units having higher pressure columns and lower pressure columns operatively associated with the higher pressure columns to produce oxygen-rich streams. The lower pressure columns are in flow communication with the at least one main heat exchanger so that the oxygen-rich streams warm within the at least one main heat exchanger and are utilized in producing the oxygen product.

An auxiliary column operates at substantially the same pressure as the lower pressure columns and is connected to at least one of the air separation units so as to receive at least one impure oxygen stream in a bottom region thereof. The at least one impure oxygen stream contains oxygen and nitrogen and has an oxygen content that is no less than that of the air. The auxiliary column is configured to rectify the at least one impure oxygen stream and thereby form an oxygen containing liquid as a column bottoms and an auxiliary column nitrogen-rich vapor column overhead. The lower pressure columns of the air separation units are connected to the auxiliary column so that oxygen containing streams are withdrawn from the auxiliary column having a lower nitrogen content of that of the at least one impure oxygen stream and are introduced into the lower pressure columns for rectification within the lower pressure columns. The cryogenic rectification installation is also configured to generate at least one liquid stream composed of air or an air-like substance having an argon content no less than air and to reflux the lower pressure columns and the auxiliary column with intermediate reflux streams composed of the at least one liquid stream above locations at which the oxygen containing streams are introduced and above the bottom region of the auxiliary column.

At least one pump can be connected to the lower pressure columns so that the oxygen-rich streams are composed of an oxygen-rich liquid column bottoms produced in the lower pressure columns. At least part of the oxygen-rich streams are pumped to form at least one pressurized liquid stream. The at least one main heat exchanger is connected to the at least one pump so that the at least part of the at least one pressurized liquid stream is introduced into the at least one main heat exchanger and warmed to form the oxygen product. The cryogenic rectification installation is configured to generate the at least one liquid stream, in part, through indirect heat exchange conducted in the least one main heat exchanger, between at least one compressed air stream composed of part of the air and the at least part of the at least one pressurized liquid stream.

The at least one impure oxygen stream can comprise impure oxygen streams withdrawn from all of the air separation units. The auxiliary column is connected to the air separation units so as to receive the impure oxygen streams in a bottom region thereof. The auxiliary column can be connected to the higher pressure columns so that the impure oxygen streams are withdrawn from the higher pressure columns and are composed of a crude liquid oxygen column bottoms produced within the higher pressure columns. A heat exchanger can be connected to the higher pressure columns and the lower pressure columns so that a higher pressure nitrogen-rich column overhead produced in the higher pressure columns is condensed into a nitrogen-rich liquid against vaporizing part of the oxygen-rich liquid column bottoms. The higher pressure columns, the lower pressure columns and the auxiliary column are connected to the heat exchanger so that reflux liquid streams composed of the nitrogen-rich liquid are introduced as reflux into the higher pressure columns and the lower pressure columns and the auxiliary column. At least one subcooling unit is positioned between the lower pressure columns and the at least one main heat exchanger so that the nitrogen-rich liquid, that is used in forming the reflux liquid streams that are fed as the reflux to the lower pressure column and the auxiliary column, is subcooled through indirect heat exchange with lower pressure nitrogen vapor streams composed of a lower pressure nitrogen column overhead produced in the lower pressure columns. The nitrogen-rich auxiliary column overhead and the at least one lower pressure nitrogen vapor stream is fully warmed in at least one main heat exchanger used in cooling the air to a temperature suitable for its rectification within the air separation units.

The higher pressure column of each of the air separation units can be connected to the at least one main heat exchanger so that the intermediate reflux streams are also introduced into the higher pressure column of each of the air separation units.

At least one main compressor is provided to compress the air and at least one pre-purification unit connected to the at least one main compressor to purify the air. At least one first booster compressor is positioned between the at least one pre-purification unit and the at least one main heat exchanger so that the part of the air is compressed within the first booster compressor to form the at least one compressed air stream. At least one second booster compressor is positioned between the at least one pre-purification unit and the at least one main heat exchanger. The at least one turboexpander is connected to the at least one main heat exchanger so that another part of the air is further compressed within the at least one second booster compressor, partly cooled within the at least one main heat exchanger and expanded within the at least one turboexpander, thereby to form at least one exhaust stream. The higher pressure columns are connected to the at least one turboexpander so that primary feed air streams composed of the at least one exhaust stream are introduced into the higher pressure columns.

In a particularly cost effective application of the present invention, the compressors, pumps and heat exchangers and etc. can be commonly used for all of the air separation units. In this regard, the at least one main compressor, the at least one pre-purification unit, the at least one first booster compressor, the at least one second booster compressor, the at least one main heat exchanger, the at least one turboexpander and the at least one pump can be one main compressor, one pre-purification unit, one first booster compressor, one second booster compressor, one main heat exchanger, one turboexpander and one pump, respectively. Also, the at least one compressed air stream is one compressed air stream produced by the one first booster compressor.

Similarly, the at least one pressurized liquid stream is one pressurized liquid stream produced by the one pump. The at least one exhaust stream is one exhaust stream produced by the one turboexpander and the primary feed air streams are composed of the one exhaust stream. The auxiliary column can be connected to the higher pressure columns so that the impure oxygen streams are withdrawn from the higher pressure columns and are composed of a crude liquid oxygen column bottoms produced within the higher pressure columns.

A heat exchanger can be connected to the higher pressure columns and the lower pressure columns so that a higher pressure nitrogen-rich column overhead produced in the higher pressure columns is condensed into a nitrogen-rich liquid against vaporizing part of the oxygen-rich liquid column bottoms. The higher pressure columns, the lower pressure columns and the auxiliary columns are connected to the heat exchanger so that reflux liquid streams composed of the nitrogen-rich liquid are introduced as reflux into the higher pressure columns and the lower pressure columns. One subcooling unit is positioned between the lower pressure columns and the one main heat exchanger so that the nitrogen-rich liquid, that is used in forming the reflux liquid streams that are fed as the reflux to the lower pressure columns and the auxiliary column, is subcooled through indirect heat exchange with one lower pressure nitrogen vapor stream composed of a lower pressure nitrogen column overhead produced in the lower pressure column. The nitrogen-rich auxiliary column overhead and the one lower pressure nitrogen vapor stream are fully warmed in the one main heat exchanger.

BRIEF DESCRIPTION OF THE DRAWINGS

While the specification concludes with claims distinctly pointing out the subject matter that Applicants regard as their invention, it is believed that the invention will be understood when taken in connection with the accompanying sole FIGURE that illustrated an apparatus for carrying out a method in accordance with the present invention.

DETAILED DESCRIPTION

With reference to the FIGURE, a cryogenic rectification installation 1 is illustrated that is designed to separate air and thereby to produce an oxygen product. Cryogenic rectification installation 1 is provided with a main heat exchanger 2 to cool the air to a temperature suitable for its rectification within air separation units 3 and 4 and thereby produce an oxygen product that is discharged from the main heat exchanger 2 as an oxygen product stream 96, to be discussed in more detail hereinafter.

The air to be separated is introduced into apparatus 1 as an air stream 10 that is compressed in a main compressor 12 to produce a main compressed air stream 14 having a pressure in a range of from between about 5 and about 15 bar(a). Main compressor 12 can be a multi-stage intercooled integral gear compressor with condensate removal. Main compressed air stream 14 is subsequently purified in a pre-purification unit 16 to remove higher boiling impurities such as water vapor, carbon dioxide and hydrocarbons from the air and thereby produce a compressed and purified air stream 18. As well known in the art, such unit 16 can incorporate adsorbent beds operating in an out of phase cycle that is a combination of temperature and pressure swing adsorption.

A part 20 of the compressed and purified air stream 18 is subsequently compressed in a booster compressor 22, again preferably a multi-stage unit, to form a first compressed air stream 24 that can have a pressure in a range of between about 25 and about 70 bar. First compressed air stream 24 can constitute roughly between about 25 percent and about 35 percent of the incoming air. As will be discussed, first compressed air stream 24 is liquefied within a main heat exchanger 2 against vaporizing a second part 94 of a pumped liquid oxygen stream 88 to produce the oxygen product stream 96 and a liquid air stream 26 in a subcooled state. Another part 28 of the compressed and purified air stream 18 is compressed in a turbine loaded booster compressor 30 to a pressure that can be in a range of between about 15 bar(a) and 20 bar(a) and then compressed in a compressor 32 to produce a second compressed air stream 34 that can have a pressure of between about 20 bar(a) and 60 bar(a). Second compressed air stream 34 is partially cooled within the main heat exchanger 2 to a temperature that is in a range of between about 160 K and about 220 K and then expanded within a turboexpander 36 to produce an exhaust stream 38 to supply refrigeration to the air separation installation 1.

It is to be noted that although main heat exchanger 2 is illustrated as a single unit, in practice, main heat exchanger 2 could be a series of parallel units incorporating known aluminum plate-fin construction. Moreover, the high pressure portion of main heat exchanger 2 could be "banked", that is, fabricated so that the portion used in exchanging heat between the first compressed stream 24 and the second part 94 of the pumped liquid oxygen stream 88 were in a separate high pressure heat exchanger. Thus, the term "main heat exchanger" as used herein and in the claims can be taken to mean a single unit or multiple units as described above. Moreover, although booster compressor 30 is illustrated as being mechanically connected to turboexpander 36 and compressor 32 is provided to further compress the compressed and purified air, single, separately driven booster compressors could be used in place of the illustrated units.

Exhaust stream 38 is divided into primary feed air streams 40 and 42 that are fed to higher pressure columns 44 and 46 of air separation units 3 and 4, respectively, for rectification therein. It is to be noted that the present invention has equal applicability to other types of air separation plants, for example, those in which the turbine exhaust is fed into the lower pressure columns. Each of the higher pressure columns 44 and 46 are provided with mass transfer contacting elements 48 and 50 such as structure packing, dumped packing or sieve trays or a combination of such elements as well known in the art. The introduction of primary feed air streams 40 and 42 initiates formation of an ascending vapor phase that becomes ever richer in nitrogen as it ascends higher pressure columns 44 and 46, respectively. The ascending vapor is in countercurrent contact with a descending liquid phase that becomes ever richer in oxygen as it descends columns 44 and 46. As a result, a crude liquid oxygen column bottoms 52 is formed in each of the higher pressure columns 44 and 46, within bottom regions thereof, and a higher pressure nitrogen-rich vapor at the top of the higher pressure columns 44 and 46.

Lower pressure columns 54 and 56 of air separation units 3 and 4, respectively, operating at a lower pressure than higher pressure columns 44 and 46, are each provided with heat exchangers in the form of condenser reboilers 58 in the base of each of the lower pressure columns 54 and 56. Streams 60 and 62 composed of the higher pressure nitrogen-rich vapor column overhead of the higher pressure columns 44 and 46, respectively, are condensed within condenser reboilers 58 to produce nitrogen-rich liquid streams 64 and 66 and to partly vaporize an oxygen-rich liquid column bottoms 68 produced in each of the lower pressure columns 54 and 56. Such vaporization initiates the formation of an ascending vapor phase within lower pressure columns 54 and 56. The descending liquid phase within lower pressure columns 54 and 56 is initiated through introduction of reflux streams 70 and 72 that are composed of the nitrogen-rich liquid streams 64 and 66. Mass transfer contacting elements 74, 76 and 78 are located within each of the lower pressure columns 54 and 56 to contact the descending liquid with the ascending vapor and thereby to produce the oxygen-rich liquid 68 and a low pressure nitrogen-rich vapor column overhead in top regions of the lower pressure columns 54 and 56.

Oxygen-rich streams 80 and 82 that are composed of the oxygen-rich liquid column bottoms 68 are removed from lower pressure columns 54 and 56 and combined to form a combined stream 84 that is pumped by a pump 86 to produce a pumped liquid oxygen stream 88 that can have a pressure from between about 10 bar(a) and about 50 bar(a). A first part of the pumped liquid oxygen stream 88 can optionally be directly taken as liquid product stream 92 and a second part 94 of the pumped liquid oxygen stream 88 can, as described above, be warmed within the main heat exchanger to produce the oxygen product as a product stream 96.

Within each of the lower pressure columns 54 and 56 as the liquid phase descends, it becomes ever richer in oxygen, the nitrogen being stripped out by the ascending vapor phase. The section of the column where such action predominantly occurs is within mass transfer contacting element 74. The sections of the lower pressure columns occupied by mass transfer contacting elements 76 and 78 are nitrogen rectification sections which serve to enrich the ascending vapor in nitrogen content. In many instances it is the uppermost sections that serve to constrain plant capacity. In accordance with the present invention, in order to overcome this limitation, a nitrogen-oxygen mixture which has been enriched in oxygen is introduced into each lower pressure column 54 and 56 that is generated in an auxiliary column 100 in lieu of crude liquid oxygen or kettle liquid generated in the bottom region of each of the higher pressure columns 44 and 46.

In cryogenic rectification installation 1, impure oxygen streams, that in the illustrated embodiment constitute crude liquid oxygen streams 102 and 104, are removed from higher pressure columns 44 and 46, respectively. These streams are composed of the crude liquid oxygen 52. The crude liquid oxygen streams 102 and 104 are then valve expanded to a pressure substantially at the operating pressure of the lower pressure columns 54 and 56 by expansion valves 106 and 108 and then introduced into a bottom region 101 of the auxiliary column 100 for rectification to produce an oxygen containing liquid column bottoms 110 and an auxiliary column nitrogen-rich vapor column overhead at the top of auxiliary column 100. Auxiliary column 100 is refluxed by a reflux stream 112 that is made up of the nitrogen-rich liquid streams 64 and 66 discussed above. In this regard, nitrogen-rich liquid stream 64 and 66 are divided into subsidiary streams 114, 116 and 118, 120, respectively. Subsidiary streams 114 and 118 reflux the higher pressure columns 44 and 46, respectively. Subsidiary streams 118 and 120 are combined to form a combined stream 122 that is subcooled in a subcooling unit 124 and then divided into reflux streams 70, 72 and 112. Reflux streams 70, 72 and 112 are valve expanded to an operational pressure of the lower pressure columns 54 and 56 and the auxiliary column 100 by expansion valves, 126, 128 and 130, respectively.

Auxiliary column 100 is provided with mass transfer contacting elements 132 and 134 to contact ascending vapor and descending liquid phases and thereby produce the oxygen containing liquid column bottoms 110 and the auxiliary column nitrogen-rich vapor column overhead. Flash-off vapor produced by the introduction of crude liquid oxygen streams 102 and 104 into auxiliary column 100 as well as introduction of intermediate reflux stream 158 (to be discussed) form the ascending phase to be rectified. The descending liquid phase is produced by reflux stream 112 and the intermediate reflux stream 158. As a result of the distillation, the oxygen containing liquid column bottoms 110 is leaner in nitrogen than the crude liquid oxygen column bottoms 52 produced in the higher pressure columns 44 and 46. Oxygen containing streams 136 and 138 that are composed of the oxygen containing liquid column bottoms 110 are removed from the auxiliary column 100 and then introduced into the base of the nitrogen rectification sections of the lower pressure columns 54 and 56 to reduce the nitrogen content within such sections of the columns and to allow for a higher production rate without such columns flooding. In this regard, such oxygen containing streams 136 and 138 might have a vapor content upon their introduction into lower pressure columns 54 and 56.

Nitrogen-rich vapor column overhead streams 140, 142 and 144 are removed from the lower pressure columns 54 and 56 and the auxiliary column, respectively and are combined to form a combined nitrogen-rich vapor stream 146. Combined nitrogen-rich vapor stream 146 is then partly warmed within subcooling unit 148 to subcool combined nitrogen liquid stream 122 and then is fully warmed within main heat exchanger 2 to form a nitrogen product stream 150.

The introduction of the oxygen containing streams 136 and 138 effectively unload the nitrogen rectification section of the lower pressure columns 54 and 56. The upper rectification sections of the low pressure columns still require sufficient reflux to maintain high oxygen recovery. In order to achieve this condition, the liquid air stream is expanded to an operational pressure of the higher pressure columns 44 and 46 by means of an expansion valve 152 and then divided and subdivided into intermediate reflux streams 154, 156 and 158 and optionally, intermediate reflux streams 160 and 162. Intermediate reflux streams 154, 156 and 158 are valve expanded to lower the pressure of such streams by expansion valves 164, 168 and 170 and then introduced as intermediate reflux into lower pressure columns 54 and 56 above locations at which the oxygen containing streams 136 and 138 are introduced and auxiliary column 100, above the bottom region thereof at which the impure oxygen streams are introduced. Optional intermediate reflux streams 160 and 162 are introduced into the higher pressure columns 44 and 46.

Although the auxiliary column 100 is illustrated in connection with two air separation units 3 and 4, in practice, an auxiliary column such as auxiliary column 100 should be able to debottleneck 3 or 4 main air separation units, although it is possible more air separation units would be used. Thus, the term, "plurality" as used herein and in the claims means two or more separation units. Additionally, although air separation units 3 and 4 are identical, air separation units of different design and capability could be used. For example, one air separation unit, as illustrated, could be a conventional double column and the second unit may incorporate argon recovery. The air separation units could also be of different types. In this regard, the qualifying aspect of an air separation unit is the utilization of a low pressure nitrogen rectification section and most known oxygen production processes will have such a section. As an example, the present invention is applicable to low purity oxygen plants that employ air condensation within the base of the lower pressure column, either total and partial air condensation. A further point is that auxiliary column 100 need not operate so as to produce nitrogen vapor at the top of the column at the same purity of any lower pressure column of the associated air separation units.

Although not illustrated, the present invention contemplates that the auxiliary column 100 operates in a manner that is independent of the associated air separation units. In particular, not all of the air separation units need be in operation at any time. If for instance, air separation unit 3 is out of service, the auxiliary column could still function in connection with air separation unit 4. Although the FIGURE depicts a common main heat exchanger 2 and a subcooling unit 124 associated with the operation of the air separation units 3 and 4, along with associated main air compressor 12, turboexpander 36 and etc., it is possible to design the cryogenic distillation installation in which each air separation unit has dedicated components such as main heat exchangers and subcooling units or partially dedicated and partial common units. For example multiple pumps or a single pump 86 could be used in the embodiment of the present invention shown in the FIGURE. It is to be noted here that although the liquid air stream 26 is illustrated as being condensed against a second part 94 of pumped liquid oxygen stream 88, it is possible to employ the present invention in connection with pumped liquid nitrogen.

A combination of feed sources may be employed for an auxiliary column system in accordance with the present invention. In addition to impure oxygen liquid streams withdrawn from the higher pressure columns 44 and 46, for example, crude liquid oxygen streams 102 and 104, interstage fluids may be extracted from either the higher or lower pressure columns associated with the air separation units 3 and 4. All that is required for the impure oxygen streams is that they contain an oxygen content that is no less than that of air. For example, the impure oxygen streams could be formed from part of the liquid air stream that is produced in vaporizing a second part 94 of the pumped liquid oxygen stream 88. Additionally, impure oxygen streams could be formed from the turbine exhaust that would otherwise be directly routed to the lower pressure column. In either case, by diverting such stream to the auxiliary column, nitrogen would also be diverted to lower the nitrogen content in the lower pressure columns 54 and 56. Also, such interstage fluids could constitute a liquid air-like substance withdrawn from the columns at the point of introduction of intermediate reflux streams, for example, 160 and 162. Such liquid, known in the art as synthetic air, could likewise be used to divert nitrogen from the lower pressure columns 54 and 56. As far as the derivation, the same holds true for the intermediate reflux streams that in the illustrated embodiment are designated by reference numbers 154, 156, 160 and 162. These streams could be composed of air or other air-like substance such as synthetic air that would have an argon content no less than air given that such synthetic air, if withdrawn at the point of introduction of streams 160 and 162, would in fact have an argon content greater than air.

A yet further point is that although the impure oxygen streams are a liquid, it is possible to use a vapor, for example, in an air separation plant having an upper column expander to feed an exhaust into the lower pressure column, in lieu thereof, such stream could be fed into the auxiliary column. In the case where argon is produced from at least one of the column systems, it is possible to route a portion of the vaporized impure oxygen into the auxiliary column.

It should be noted that the feed source to the auxiliary column 100 may be derived from only a single air separation unit, for example air separation unit 3 or air separation unit 4 and then be divided amongst the associated air separation units.

Although the present invention has been described with reference to a preferred embodiment, as will occur to those skilled in the art, numerous changes, additions and omissions can be made to such embodiment without departing from the spirit and scope of the present invention as set forth in the appended claims.

We claim:

1. A method of producing an oxygen product comprising:

separating air by a cryogenic rectification process employing a plurality of air separation units having higher pressure columns and lower pressure columns operatively associated with the higher pressure columns to produce oxygen-rich streams that are utilized in producing the oxygen product, the cryogenic rectification process generating at least one liquid stream composed of air or an air-like substance having an argon content no less than air and at least one impure oxygen stream containing oxygen and nitrogen and having an oxygen content no less than that of the air;

introducing the at least one impure oxygen stream into a bottom region of an auxiliary column operating at substantially the same pressure as the lower pressure column and rectifying the at least one impure oxygen stream in a rectification conducted within the auxiliary column to form an oxygen containing liquid as a column bottoms and an auxiliary column nitrogen-rich vapor column overhead;

withdrawing oxygen containing streams from the auxiliary column having a lower nitrogen content than that of the at least one impure oxygen stream and introducing the oxygen containing streams into the lower pressure columns for rectification within the lower pressure columns;

introducing intermediate reflux streams composed of the at least one liquid stream into the lower pressure columns above locations at which the oxygen containing streams are introduced and into the auxiliary column above the bottom region thereof and the at least one impure oxygen stream and rectifying the intermediate reflux streams within the lower pressure columns and the auxiliary column; and the at least one impure oxygen stream valve expanded to initiate formation of an ascending vapor phase within the auxiliary column for the rectification conducted within the auxiliary column and the ascending vapor phase produced solely as a result of the introduction of the at least one impure oxygen stream and one of the intermediate reflux streams into the auxiliary column.

2. The method of claim 1, wherein the at least one impure oxygen stream is formed from impure oxygen streams withdrawn from all of the air separation units and introduced into the auxiliary column.

3. The method of claim 2, wherein:

the oxygen-rich streams are composed of an oxygen-rich liquid column bottoms produced in the lower pressure columns;

at least part of each of the oxygen-rich liquid streams are pumped to form at least one pumped liquid oxygen stream; and part of the air to be separated is compressed to form at least one compressed air stream; and the at least one compressed air stream indirectly exchanges heat with at least part of the at least one pumped liquid oxygen stream, thereby forming the at least one liquid stream from the compressed air stream and the oxygen product from the at least part of the at least one pumped liquid oxygen stream.

4. The method of claim 3, wherein the impure oxygen streams are withdrawn from the higher pressure columns and are composed of a crude liquid oxygen column bottoms produced within the higher pressure columns of the air separation units.

5. The method of claim 3, wherein:

a higher pressure nitrogen-rich column overhead produced in the higher pressure colunms is condensed into a nitrogen-rich liquid against vaporizing part of the oxygen-rich liquid column bottoms;

reflux liquid streams composed of the nitrogen-rich liquid are introduced as reflux into the higher pressure columns and the lower pressure columns and the auxiliary column; and the nitrogen-rich liquid that is used in forming the reflux liquid streams that are fed as the reflux to the lower pressure columns and the auxiliary column is subcooled through indirect heat exchange with at least one lower pressure nitrogen vapor stream composed of a lower pressure nitrogen column overhead produced in the lower pressure columns of the air separation units and the nitrogen-rich auxiliary column overhead; and the at least one lower pressure nitrogen vapor stream is fully warmed in at least one main heat exchanger used in cooling the air to a temperature suitable for rectification within the air separation units.

6. The method of claim 3, wherein the intermediate reflux streams are also introduced into the higher pressure column of each of the air separation units.

7. The method of claim 3, wherein:

another part of the air is further compressed, partly cooled and expanded, thereby to form at least one exhaust stream; and primary feed air streams composed of the at least one exhaust stream are introduced into the higher pressure columns.

8. An apparatus for producing an oxygen product comprising:

a cryogenic rectification installation configured to separate air and thereby produce the oxygen product;

the cryogenic rectification installation including at least one main heat exchanger and air separation units having higher pressure columns and lower pressure columns operatively associated with the higher pressure columns to produce oxygen-rich streams;

the lower pressure columns in flow communication with the at least one main heat exchanger so that the oxygen-rich streams warm within the at least one main heat exchanger and are utilized in producing the oxygen product;

an auxiliary column operating at substantially the same pressure as the lower pressure columns and connected to at least one of the air separation units so as to receive at least one impure oxygen stream in a bottom region thereof, the at least one impure oxygen stream eontaining oxygen and nitrogen and having an oxygen content that is no less than that of the air;

an expansion valve positioned to expand the at least one impure oxygen stream prior to introduction of the at least one impure oxygen stream within the auxiliary column;

the auxiliary column configured to conduct a rectification in which the at least one impure oxygen stream is rectified, an oxygen containing liquid as a column bottoms and an auxiliary column nitrogen-rich vapor column overhead are formed and expansion of the at least one impure oxygen stream initiates formation of an ascending vapor phase within the auxiliary column for the rectification conducted within the auxiliary column;

the lower pressure columns of the air separation units connected to the auxiliary column so that the oxygen containing streams are withdrawn from the auxiliary column having a lower nitrogen content of that of the at least one impure oxygen stream and are introduced into the lower pressure columns for rectification within the lower pressure columns;

the cryogenic rectification installation also configured to generate at least one liquid stream composed of air or an air-like substance having an argon content no less than air and to reflux the lower pressure columns and the auxiliary column with intermediate reflux streams composed of the at least one liquid stream above locations at which the oxygen containing streams are introduced and above the bottom region of the auxiliary column and the at least one impure oxygen stream and rectify the intermediate reflux streams within the lower pressure columns and the auxiliary column; and the ascending vapor phase produced solely as a result of the introduction of the at least one impure oxygen stream and one of the intermediate reflux streams into the auxiliary column.

9. The apparatus of claim 8, wherein the at least one impure oxygen stream comprises impure oxygen streams and the auxiliary column is connected to all of the air separation units so as to receive the impure oxygen streams in the bottom region thereof.

10. The apparatus of claim 9, wherein:

at least one pump is connected to the lower pressure columns so that the oxygen-rich streams are composed of an oxygen-rich liquid column bottoms produced in the lower pressure columns and at least part of each of the oxygen-rich streams are pumped to form at least one pressurized liquid stream; the at least one main heat exchanger is connected to the at least one pump so that the at least part of the at least one pressurized liquid stream is introduced into the at least one main heat exchanger and warmed to form the oxygen product; and the cryogenic rectification installation is configured to generate at least one liquid stream, in part, through indirect heat exchange conducted in the least one main heat exchanger, between at least one compressed air stream composed of part of the air and the at least part of the at least one pressurized liquid stream.

11. The apparatus of claim 10, wherein the auxiliary column is connected to the higher pressure columns so that the plurality of the impure oxygen streams are withdrawn from the higher pressure columns and are composed of a crude liquid oxygen column bottoms produced within the higher pressure columns.

12. The apparatus of claim 10, wherein:

a heat exchanger is connected to the higher pressure columns and the lower pressure columns so that a higher pressure nitrogen-rich column overhead produced in the higher pressure columns is condensed into a nitrogen-rich liquid against vaporizing part of the oxygen-rich liquid column bottoms;

the higher pressure columns, the lower pressure columns and the auxiliary column connected to the heat exchanger so that reflux liquid streams composed of the nitrogen-rich liquid are introduced as reflux into the higher pressure columns, the lower pressure columns and the auxiliary column;

at least one subcooling unit positioned between the lower pressure columns and the at least one main heat exchanger so that the nitrogen-rich liquid that is used in forming the reflux liquid streams, that are fed as the reflux to the lower pressure column and the auxiliary column, is subcooled through indirect heat exchange with lower pressure nitrogen vapor streams composed of a lower pressure nitrogen column overhead produced in the lower pressure columns; and the nitrogen-rich auxiliary column overhead and the at least one lower pressure nitrogen vapor stream is fully warmed in at least one main heat exchanger used in cooling the air to a temperature suitable for rectification within the air separation units.

13. The apparatus of claim 10, wherein the higher pressure column of each of the air separation units are connected to the at least one main heat exchanger so that the intermediate reflux streams are also introduced into the higher pressure column of each of the air separation units.

14. The apparatus of claim 10, wherein:

the cryogenic rectification installation has at least one main compressor to compress the air and at least one pre-purification unit connected to the at least one main compressor to purify the air;

at least one first booster compressor is positioned between the at least one pre-purification unit and the at least one main heat exchanger so that the part of the air is compressed within the first booster compressor to form the at least one compressed air stream;

at least one second booster compressor is positioned between the at least one pre-purification unit and the at least one main heat exchanger;

at least one turboexpander is connected to the at least one main heat exchanger so that another part of the air is further compressed within the at least one second booster compressor, partly cooled within the at least one main heat exchanger and expanded within the at least one turboexpander, thereby to form at least one exhaust stream; and the higher pressure columns are connected to the at least one turbo expander so that primary feed air streams composed of the at least one exhaust stream are introduced into the higher pressure columns.

15. The apparatus of claim 14, wherein:

the at least one main compressor, the at least one pre-purification unit, the at least one first booster compressor, the at least one second booster compressor, the at least one main heat exchanger, the at least one turboexpander and the at least one pump, are out main compressor, one pre-purification unit, one first booster compressor, one second booster compressor, one main heat exchanger, one turboexpander and one pump, respectively;

the at least one compressed air stream is one compressed air stream produced by the one first booster compressor;

the at least one pressurized liquid stream is one pressurized liquid stream produced by the one pump, the at least one exhaust stream is one exhaust stream produced by the one turhoexpander; and the primary feed air streams are composed of the one exhaust stream.

16. The apparatus of claim 15, wherein the auxiliary column is connected to the higher pressure columns so that the impure oxygen streams are withdrawn from the higher pressure columns and are composed of a crude liquid oxygen column bottoms produced within the higher pressure columns.

17. The apparatus of claim 16, wherein:

a heat exchanger is connected to the higher pressure columns and the lower pressure columns so that a higher pressure nitrogen-rich column overhead produced in the higher pressure columns is condensed into a nitrogen-rich liquid against vaporizing part of the oxygen-rich liquid column bottoms;

the higher pressure columns, the lower pressure columns and the auxiliary columns connected to the heat exchanger so that reflux liquid streams composed of the nitrogen-rich liquid are introduced as reflux into the higher pressure columns and the lower pressure columns;

one subcooling unit is positioned between the lower pressure columns and the one main heat exchanger so that the nitrogen-rich liquid, that is used in forming the reflux liquid streams that are fed as the reflux to the lower pressure columns and the auxiliary column, is subcooled through indirect heat exchange with one lower pressure nitrogen vapor stream composed of a lower pressure nitrogen column overhead produced in the lower pressure column and the nitrogen-rich auxiliary column overhead; and the one lower pressure nitrogen vapor stream is fully warmed in the one main heat exchanger.

* * * * *